United States Patent [19]

Norris

[11] 3,986,235

[45] Oct. 19, 1976

[54] SPACE DYEING OF TEXTILE STRANDS

[75] Inventor: Alan H. Norris, Rome, Ga.

[73] Assignee: Champion International Corporation, Stamford, Conn.

[22] Filed: June 26, 1975

[21] Appl. No.: 590,425

[52] U.S. Cl. ..... 28/74 P; 8/14; 8/154; 8/155; 68/200; 112/410

[51] Int. Cl.[2] ..... D06P 3/00; D06P 7/00; D05C 17/02

[58] Field of Search ..... 8/14, 154, 155; 28/74 R, 74 P, 76 R, 76 P, 75 R

[56] References Cited

UNITED STATES PATENTS

| | | | |
|---|---|---|---|
| 3,120,422 | 2/1964 | Weir | 8/14 |
| 3,335,583 | 8/1967 | Schutte | 68/203 |
| 3,464,779 | 9/1969 | Collez | 8/14 |
| 3,724,997 | 4/1973 | Vondereltz | 8/14 |

*Primary Examiner*—John Kight, III
*Attorney, Agent, or Firm*—Evelyn M. Sommer

[57] ABSTRACT

Space-dyed textile strands are provided by a process which comprises contacting each of the substantially flat ends of a wound yarn package with a color modifying agent, withdrawing the yarn from the yarn package and rewinding the yarn in reverse order into a second yarn package having at least one substantially flat end, and contacting each of the flat ends of the rewound yarn package with a color modifying agent. The color modifying agent can comprise, for example, a dye, a chemical compound effecting the absorbtivity of dyes or the like. The yarn is withdrawn from the second yarn package, woven or tufted into a carpet, for example, and dyed, resulting in a carpet having random, small flecks of contrasting color therein.

12 Claims, 5 Drawing Figures

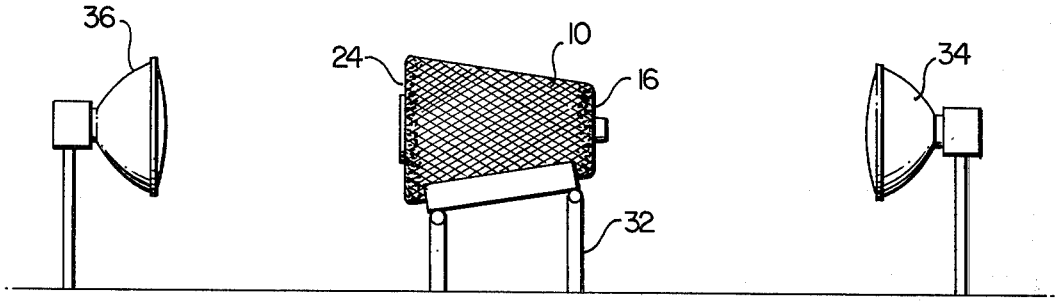
FIG. 3
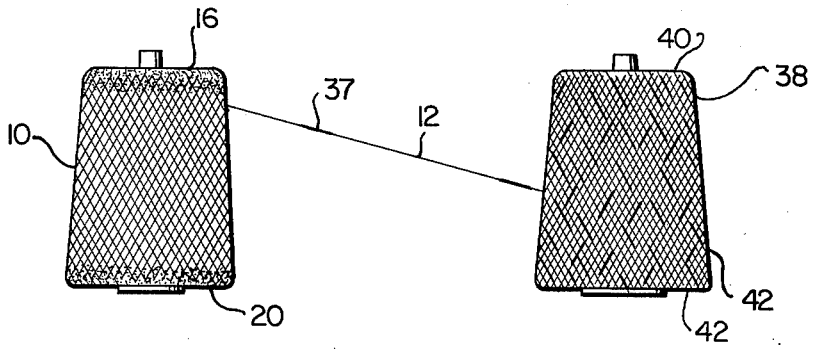
FIG. 4
FIG. 5
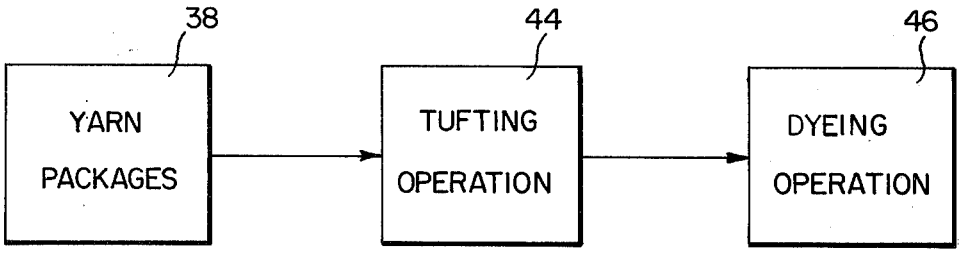

SPACE DYEING OF TEXTILE STRANDS

This invention relates to a process for space dyeing textile strands. More particularly, this invention relates to a process for random dyeing of yarn while the yarn is provided in a wound yarn package.

Various processes have been proposed for the space or random dyeing of yarn wherein the yarn is dyed at random areas, and the carpet ultimately produced from such yarn is provided with small flecks of contrasting color in the yarn pile. One of the processes for producing space dyed yarn involves the printing of colors onto warps (open yarn sheets) by contacting the yarn with rollers that are covered with the dye in an intermittent programmed manner. The roller printing processes generally produce long lengths of color (on the order of 6 to 9 inches), because the yarn cannot be moved fast enough in and out of contact with the roller.

Another process is known as the "knit, de-knit method" wherein the yarn is actually knitted into the form of an article, such as a tube, and thereafter a dyestuff is applied. The article is then subjected to fixing, washing, rinsing and drying. Thereafter, the article is de-knitted in order to obtain random or space-dyed yarn, which can be used for the production of tufted carpets, for example. The knit, de-knit method tends to result in less bulky yarn than ordinarily desired with a retention of the knitted tube shapes in the yarn, and provides kinky short (one inch approximately) spaced-dyed yarn.

Still another process for producing space-dyed yarns involves the injection of a dyestuff into a wound package of cellulosic yarn, and the yarn package is permitted to stand until chemical reaction between the dyestuff and the fibers of yarn has occurred. The dyestuff is injected into the yarn package with a hollow injection needle or the like. The injection process is difficult to control and results in yarn packages having a great variation from package to package. The package density varies even from the same winding machine. Additionally, the injection process is generally limited to cellulose fibers because the dye utilized for injection is an "internal" dye which cannot be heated to fix the dye.

It has now been found that textile strands including both natural and synthetic yarns can be space dyed in a relatively simple manner by a process which comprises providing a first wound yarn package having at least one substantially flat end with exposed yarn reversals, contacting each of the flat ends with a color modifying agent, withdrawing the yarn from the first yarn package and rewinding the yarn in reverse order into a second yarn package having at least one substantially flat end with exposed yarn reversals, and contacting each of the flat ends of the second yarn package with a color modifying agent.

In this manner, the yarn reversals at the ends of the packages are treated with a dye or other suitable color modifier which results in a random spacing of color flecks in the yarn. The yarn is then rewound in reverse order into a second yarn package so that the yarn previously in the center of the package is now generally on the outside and the second yarn package is then contacted with a color modifying agent on the flat ends. By rewinding the yarn in reverse order onto a second yarn package and dyeing the resulting flat ends, the differences in length between the yarn reversals at the ends of the packages, which vary with the diameter of the yarn package are corrected, and also more random spacing of the color flecks are produced.

The second yarn package may be used to provide woven or tufted carpet or the like. After the yarn is tufted to carpet, the carpet may then be completely dyed by beck, printer or the like, which results in contrasting flecks of color on the previously treated yarn.

In the event that a color modifying agent in the form of a dyestuff is employed, the flat ends of the yarn packages may be dried at temperatures which fix the dye. Unlike the injection method previously mentioned, the process of the present invention may be utilized for space dyeing synthetic polymer fiber as well as cellulosic fibers, since the dyed yarn reversals at the flat ends of the yarn packages are exposed and may be subjected to any suitable temperatures and heating means in order to fix the dye. Thus, for example, disperse dyes may be dried at temperatures in the 220°–260° C range to fix the dyes by the "Thermosol" process. On the other hand, the injected dyes of the injection process are inside of the yarn package and unexposed, so that high temperature heating of the dyes is not possible.

The term "color modifying agent" as used in the present application is intended to include, for example, any chemical agent which is capable of modifying the color of the yarn by providing a color in the yarn, such as a dye, or leads to the color modification of the yarn, such as by effecting the degree of absorption of dyes in the yarn. Thus, suitable color modifying agents include the conventional disperse dyes, which dyes are well known to the art and include the anthraquinoid dyestuffs, such as hydroxy anthraquinones and/or amino anthraquinones, azo dyestuffs, quinophthalone dyestuffs, stryl dyestuffs, nitrodiarylamines or the like. Such dyestuffs have the common feature of an absence of water-solubilizing groups, and are for the most part thermosoluble in synthetic polymers. Accordingly, such dyes may be dried at temperatures which fix the dye by the Thermosol process, e.g., temperatures in the range of between about 200° and about 240° C. for a period of between about 3 and about 60 seconds. Exemplary disperse dyes include C.I. Disperse Red 60, C.I. Disperse Yellow 54, C.I. Disperse Blue 120, or the like.

Other suitable dyes include the well-known acid dyes, which are generally salts of organic acids, such as sulfonic and carboxylic acids, which are generally-available in the form of sodium salts. The acid dyes contain acid groups which confer water solubility on the dyestuff molecule, and when dissolved, the dye ionizes with the dye structure in the anionic portion of the molecule. Exemplary acid dyes include Levanol C.I. Acid Yellow 19, C.I. Acid Red 66, C.I. Acid Blue 25, or the like.

The acid dyes may be fixed at a pH of about 3 to 6 while heating at temperatures generally in the range of between about 110° C. depending upon the nature of the yarn, the dye, etc. The suitable temperature may be easily determined experimentally by those skilled in the art. Another form of color modifying agent involves those compounds which alter the dye properties of the yarn, such as compounds which increase the absorption of dyes, or those compounds which decrease the absorption of dyes. For example, compounds, such as benzyl alcohol on nylon will increase the absorption of dyestuffs on the nylon yarn at those areas where the benzyl alcohol is applied. Accordingly, after the yarn is unwound from the second yarn package after having been treated on the flat ends of the yarn package and then tufted into carpet and dyed, the dyes will be absorbed into the yarn more readily at the areas where the benzyl alcohol has been applied as compared with areas absent the benzyl alcohol and will yield flecks of contrasting degrees of color. Other color modifying agents include biphenyl on polyester yarn, which increases the absorption of dyes on the polyester, and Nylon Resist C-Verona, which reduces the absorption of acid dyes on nylon. Such materials are well known to the art.

As previously mentioned, the process of the present invention may be utilized with either cellulosic fibers or synthetic polymeric fibers in view of the ready exposure of the flat ends of the yarn package, thereby permitting the ready application of heat in order to fix the dyes. Accordingly, the process of the present invention may be utilized for the space or random dyeing of synthetic yarns of nylon, polyesters, acrylics, polypropylene and acetates, as well as cellulosic yarns.

Further advantages of the invention will appear from the description of the drawings as follows wherein:

FIG. 3 is a side elevational view of a drying operation according to the present invention;

FIG. 4 is a perspective view of the yarn cone of FIG. 3 being unwound and rewound; and FIG. 5 is a flow diagram indicating the steps involved in utilizing and treating the dyed yarn package after being treated by the random color modification process of the invention.

Figure 1:
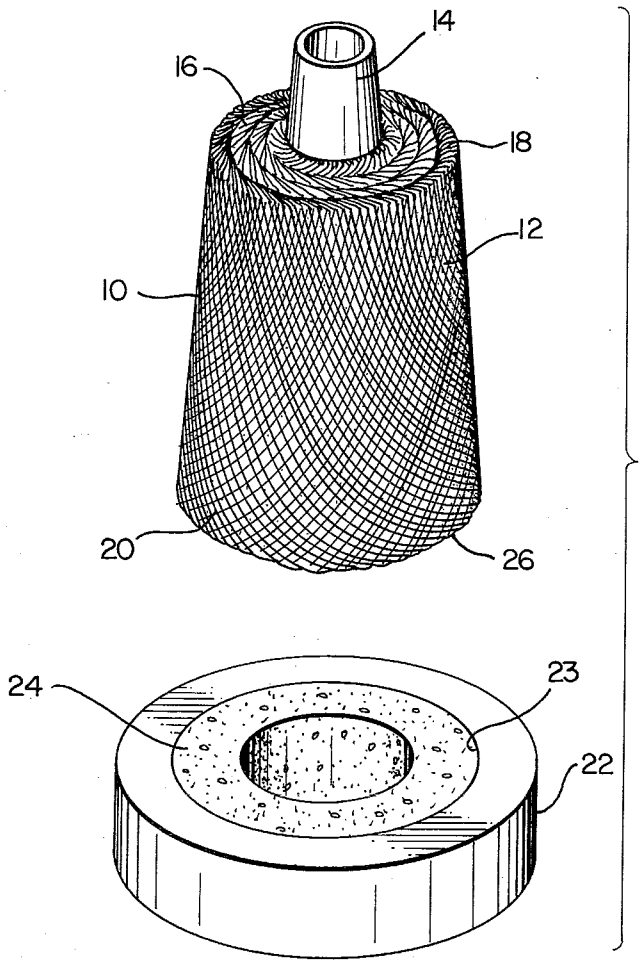
FIG. 1 is a perspective of a cone of yarn in position to be padded on the cone base flat end according to the present invention.

Referring now to FIG. 1, yarn package 10 consists of yarn 12 that is wound on cone 14. The substantially flat end 16 at the cone nose consists of undyed yarn reversals 18 which occur at the substantially flat end 16 and the substantially flat end 20 at the cone base. Although a yarn cone is illustrated in FIG. 1, the yarn may be formed into any suitable package including cylindrical or low taper cone, cheese or the like, so long as at least one substantially flat end is provided with yarn reversals, i.e., the small exposed loops made by the yarn after it has traversed one side of the yarn package, e.g., cone or the like, and returns to traverse a different side of the yarn package. Typical packages utilized for tufting carpet are 10 or 12 inch traverse or 10 or 12 inch cylindrical or low taper cones weighing between 6 and 10 pounds.

The yarn package 10 is accompanied in FIG. 1 with a receptacle 22 having a hollow inside portion 23 having a diameter of appropriate size to accept the cone base flat end 20 of the yarn cone 10. Receptacle 22 is provided with a sponge 24 which contains a suitable dye solution or other color modifying agent. The flat end 20 of the yarn cone 10 is brought into contact with the sponge 24 for a time sufficient to permit the color modifying agent to permeate the yarn reversals 26 in the flat end 20.

Figure 2:
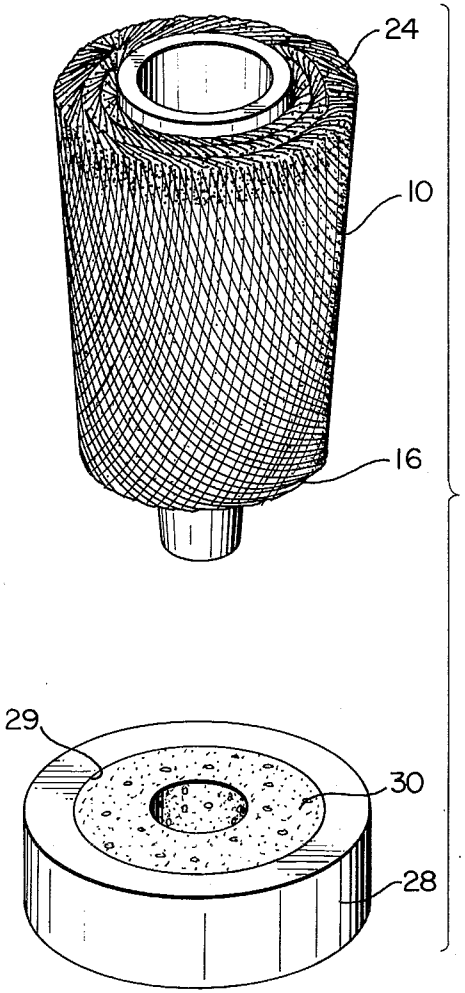
FIG. 2 is a perspective view of the cone of yarn of FIG. 1 in position to be padded on the cone nose side according to the present invention.

Referring now to FIG. 2, the yarn cone 10 now having a dyed flat end 24 is inverted and the undyed flat end 16 of the cone nose may now be brought into contact with a second receptacle 28 which is identical to receptacle 22 with the exception that it is provided with a hollow portion 29 having an inside diameter of suitable size to accept substantially flat end 16. Likewise, receptacle 28 is provided with sponge 30 that is provided with a color modifying agent identical to that provided in sponge 24.

After the cone 10 has been dyed on flat ends 16 as shown in FIG. 2, the next operation will depend upon the nature of the color modifying agent. Thus, if the color modifying agent is a dye or dyes, the dyed flat ends are subjected to drying and fixation of the dye.

Referring now to FIG. 3, cone 10 is placed in a suitable holder 32 and subjected to heat for a predetermined period of time by means of, for example, infrared lamps 34 and 36. The time and temperature required for fixation of the dyes will depend upon the nature of the dyes and the yarn undergoing treatment. If the yarn is a synthetic yarn and a disperse dye is employed, then the dyed flat ends 16 and 24 may be subjected to temperatures in the range of between about 200° and about 250° C. for a period of between about 3 and about 60 seconds.

In the event that the color modifying agent is an acid dye, then the dyed flat ends may be subjected to temperatures in the range of between about 95° and about 110° C. until the flat ends are dried. Alternatively, if the color modifying agent is a compound which affects the absorption of a dye in the fiber, then the severity and duration of the heat treatment of FIG. 3 will depend upon the nature of the treating agent. Thus, if benzyl alcohol is applied to nylon, the heat treatment will normally be at a temperature of about 100° C. and for a period of about 5 minutes.

Similarly, the color modifying agent may include a dye and a binding agent, such as a starch, which serves to adhere the dye to the yarn without the need for a fixing operation. In that event, the operation shown in FIG. 3 may be conducted at low temperature drying conditions in the range of between about 50° and about 100° C.

Referring now to FIG. 4, the cone 10 is unwound and rewound to form cone 38. The yarn previously in the center of the yarn cone 10 is now on the outside of the yarn package 38. By rewinding the yarn to form a second yarn package 38, this will correct the difference in length between the yarn reversals at the ends of the packages which varies with the diameter of the yarn package, and also serve to produce more random spacing of the color flecks 37 on yarn 12.

The color package is now subjected to the color modification of its substantially flat ends 40 and 42 in the manner shown in FIGS. 1 and 2. Thereafter, the yarn cone 38 is then subjected to the drying step as illustrated in FIG. 3.

The resulting yarn cone 38 after treatment in the manner shown in FIG. 2 has yarn having dyed lengths 37 of about 1 inch in size, spaced by between 1 to 2 feet of yarn 12 depending upon the size of the yarn cone.

Although FIGS. 1 and 2 demonstrate the use of one particular type of color modifying agent applicator to the yarn cone ends, it should be understood that any suitable means of applying a color modifying agent to the substantially flat ends of the yarn packages may be employed. Thus, the color modifying agent may be sprayed, padded, printed or otherwise treated in order to provide a color modifying agent on the flat ends.

Referring now to FIG. 5, the yarn package 38 after being dyed, dried and fixed, may be used to feed tufter 44 wherein the yarn is tufted or may be woven (by means not shown) into carpet. The carpet is then subjected into dyeing operations 46. The resulting carpet has small flecks of contrasting color in the pile yarn. In the event that the color modifying agent comprises a starch or similar binding agent, the carpet is subjected to an operation which removes the binding agent.

The invention is further illustrated by the following example. The percentages are by weight unless otherwise specified.

EXAMPLE

Employing the system of FIGS. 1 and 2, nylon yarn in the form of a low taper cone package is padded on the substantially flat ends of the base and nose portions of the cone with a print formulation comprising 0.6 percent of the thickener, Propagcyl S, 4 percent n-butyl alcohol and 1.0 percent benzyl alcohol, which affect surface tension, dye solubility and fiber opening, 1 percent of the foaming agent, Levalin VKU, 3.0 percent formic acid, 0.2 percent Levalan Yellow GR, 0.2 percent Telon Red FL, and 0.3 percent Alezaline Sky Blue B. The aforesaid dyes provide a brown color.

Next, the dyed nylon yarn package is heated in the manner shown in FIG. 3 in order to subject the flat ends to a temperature in the range of about 100°·C. for a period of about one hour until the ends are dry and the dyes are fixed. The yarn cone is then unwound and rewound into a substantially identical yarn cone as shown in FIG. 4. The rewound cone is then padded with the above formulation in the manner of FIGS. 1 and 2 and heated in the manner of FIG. 3 to fix the dyes.

The yarn cone is then employed along with similar cones to feed a tufting machine and tuft the nylon yarn into a carpet backing. The resulting carpet is then dyed to provide a yellow carpet with brown flecks of random color.

In end use situations where the degree of randomness or periodicity of the single yarn produced by the process of the present invention is inadequate, the degree of randomness may be increased by plying yarns having different pattern frequencies together. For example, two individual yarn packages may give a pattern repeat equal to the length of the yarn on the cone if one of the cones were rewound prior to yarn assembly. The outside yarn on one package could then be assembled with the inside yarn on the other package, and the resulting two ply yarn would give an increased degree of randomness.

Although the invention has been described in considerable detail with particular reference to certain preferred embodiments thereof, variations and modifications can be effected within the spirit and scope of the invention as described herein and before and as defined in the appended claims.

What is claimed is:

1. A process for space dyeing of yarn, which comprises providing a first wound yarn package having at least one substantially flat end having exposed yarn reversals, contacting each of said substantially flat ends of said first yarn package with a color modifying agent, withdrawing said yarn from the said first yarn package, rewinding said yarn in reverse order into a second yarn package having at least one substantially flat end having exposed yarn reversals, and contacting each said flat ends of said second yarn package with a color modifying agent.

2. The process of claim 1 wherein each of said yarn package is in the form of a low taper cone having two substantially flat ends.

3. The process of claim 1 wherein said color modifying agent is a dye.

4. The process of claim 3 wherein said dye is a disperse dye.

5. The process of claim 4 wherein said yarn is a synthetic polymer and each of said substantially flat ends of said yarn packages is subjected to a heat treatment at a temperature in the range of 200° and 260° C. to fix the dye.

6. The process of claim 1 wherein said color modifying agent comprises a compound capable of increasing the absorption of dyes.

7. The process of claim 1 wherein said color modifying agent comprises a compound capable of decreasing the absorption of dyes.

8. The process of claim 1 where said color modifying agent is contacted with each of said flat ends by contacting each end of the yarn package in a receptacle provided with resilient, absorbent dye applicator means.

9. The process of claim 1 wherein said color modifying agent comprises a dye and a chemical binding agent.

10. The process of claim 9 wherein said chemical binding agent is starch.

11. The process of claim 1 wherein the yarn is withdrawn from the second yarn package, tufted into a carpet backing, and said tufted carpet is dyed.

12. A process for providing random dyed multi-ply yarn, which comprises:

providing a first wound yarn package having at least one substantially flat end having exposed yarn reversals;

contacting each of said substantially flat ends of said first yarn package with a color modifying agent;

withdrawing said yarn from said first yarn package, and rewinding said yarn in reversed order into a second yarn package having at least one substantially flat end having exposed yarn reversals;

contacting each of said flat ends of said second yarn package with a color modifying agent;

contacting each of said flat ends of said second yarn package with a color modifying agent;

repeating the foregoing process with a second portion of yarn to form a third and a fourth yarn package;

rewinding said fourth yarn package into a fifth yarn package; and combining the free end of said second yarn package with the free end of said fifth yarn package to form a randomly dyed, two ply yarn having an increased degree of randomness.

* * * * *